US008794804B2

(12) United States Patent
Verfuerth et al.

(10) Patent No.: US 8,794,804 B2
(45) Date of Patent: Aug. 5, 2014

(54) SYSTEM AND METHOD FOR SUPPORTING AND LEVELING A LIGHT FIXTURE

(75) Inventors: Neal R. Verfuerth, Manitowoc, WI (US); Kenneth J. Wetenkamp, Plymouth, WI (US)

(73) Assignee: Orion Energy Systems, Inc., Manitowoc, WI (US)

( * ) Notice: Subject to any disclaimer, the term of this patent is extended or adjusted under 35 U.S.C. 154(b) by 218 days.

(21) Appl. No.: 13/275,536

(22) Filed: Oct. 18, 2011

(65) Prior Publication Data

US 2013/0094230 A1 Apr. 18, 2013

(51) Int. Cl.
*F21V 21/008* (2006.01)
*F21V 21/088* (2006.01)
*F21V 21/16* (2006.01)

(52) U.S. Cl.
USPC ..... 362/396; 362/217.17; 362/220; 362/404; 362/457; 248/327; 248/342

(58) Field of Classification Search
USPC ..... 362/217.12, 217.13, 217.14, 217.16, 362/217.17, 220, 225, 396, 403, 404, 405, 362/406, 407, 408, 409, 457; 248/317, 320, 248/322, 323, 327, 339, 341, 342, 321
See application file for complete search history.

(56) References Cited

U.S. PATENT DOCUMENTS

| | | | | | |
|---|---|---|---|---|---|
| 265,292 | A | * | 10/1882 | Wheeler | 362/349 |
| 656,007 | A | * | 8/1900 | Barrow | 248/317 |
| 2,291,490 | A | * | 7/1942 | Naysmith | 362/221 |
| 2,736,528 | A | * | 2/1956 | Le Brock | 248/317 |
| 3,911,638 | A | | 10/1975 | Englund et al. | |
| 3,995,823 | A | | 12/1976 | Hensel | |
| 4,160,344 | A | | 7/1979 | Brugman | |
| 4,545,166 | A | * | 10/1985 | Kielmeyer | 52/506.06 |
| 5,012,398 | A | * | 4/1991 | Jones et al. | 362/249.07 |
| 6,945,501 | B2 | | 9/2005 | Thompson | |
| 7,117,650 | B2 | | 10/2006 | Dockery | |
| 7,178,776 | B2 | | 2/2007 | Buck et al. | |
| 7,316,247 | B2 | | 1/2008 | Thompson | |
| 2005/0180132 | A1 | * | 8/2005 | Chung | 362/217 |

* cited by examiner

*Primary Examiner* — Alan Cariaso
(74) *Attorney, Agent, or Firm* — Foley & Lardner LLP

(57) ABSTRACT

A system for supporting and leveling a light fixture having a fixture body supporting one or more light sources, and connectors on the fixture body, and a pair of V-shaped hanger rods, where each hanger rod has an apex area and first and second ends, and the first and second ends are each configured to be coupled to one of the connectors. A pair of suspension rods are each configured to engage an overhead structure. A pair of spring clip brackets each having a slot and an aperture are releasably and adjustably secured along the length of one of the suspension rods, and also have a receptacle with a locking tab that receives and retains the apex area of one of the hanger rods.

11 Claims, 6 Drawing Sheets

SYSTEM AND METHOD FOR SUPPORTING AND LEVELING A LIGHT FIXTURE

FIELD

The field of the disclosure relates generally to lighting devices. More specifically, the disclosure relates to a light fixture configured to be supported from an overhead structure. More particularly, the disclosure relates to a hanging and leveling system for quickly and conveniently suspending or supporting and/or leveling a fluorescent or other type of light fixture from any of a wide variety of overhead structures.

BACKGROUND

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

Lighting devices such as fluorescent light fixtures for interior applications (e.g. overhead fixtures in a building etc.) are typically supported in a suspended framework (e.g. for modular ceiling panels or the like), or are suspended directly from overhead structures. Suspended frameworks are typically installed and leveled separately for use with the ceiling panels. However, in some lighting applications such as high-bay lighting applications where ceiling panels (and their associated frameworks) are typically not used, the lighting fixtures are usually suspended from any of a wide variety of overhead structures which may (or may not) be relatively planar and/or level. In such applications, the fixtures are typically suspended from chains, wire rope, cables, or the like, which can be individually shortened or lengthened as necessary to arrange multiple fixtures at a relatively common elevation, and so that each fixture is substantially level to accomplish the intended lighting illumination pattern that is associated with the location and layout of the fixtures. The conventional use of chains, cables, ropes and the like for hanging and leveling lighting fixtures suffers from a number of important disadvantages, including tedious and time-consuming installation practices that occasionally result in inadequate installation of the fixtures.

Accordingly, it would be desirable to provide a hanging and leveling system for quickly and conveniently suspending or supporting lighting fixtures such as fluorescent light fixtures, LED light fixtures, hybrid fluorescent/LED light fixtures, and other types of light fixtures from any of a wide variety of overhead structures.

SUMMARY

In an exemplary embodiment, a light fixture includes a fixture body supporting one or more light sources, and a plurality of connectors on the fixture body. A pair of hanger members each have an apex area, and first and second ends that are each configured to be coupled to one of the connectors. A pair of suspension members are provided, where each suspension member is configured to engage an overhead structure, and a pair of brackets are provided, where each bracket is configured to be releasably and adjustably secured at a location along the length of one of the suspension members, and configured to receive and retain the apex area of one of the hanger members, so that the light fixture can be quickly and easily supported and leveled by adjusting the position of the bracket along the suspension member.

In another exemplary embodiment, a light fixture includes a fixture body supporting one or more light sources, and a plurality of connectors on the fixture body. A pair of V-shaped hanger rods each have an apex area, and first and second ends that are each configured to be coupled to one of the connectors. A pair of suspension rods are provided, each suspension rod is configured to engage an overhead structure. A pair of spring clip brackets are provided, each spring clip bracket having a slot and an aperture configured to be releasably and adjustably secured along the length of one of the suspension rods, and also having a receptacle with a locking tab configured to receive and retain the apex area of one of the hanger rods.

In a further exemplary embodiment, a method for supporting and leveling a light fixture having a plurality of connectors includes the following steps. Coupling a pair of substantially V-shaped hanger rods to the light fixture, each hanger rod having an apex area and first and second ends, by coupling each of the first and second ends of each hanger rod to one of the connectors. Coupling a pair of suspension rods to an overhead structure. Coupling one each of the hanger rods to one each of the suspension rods with a spring clip bracket, each spring clip bracket having a slot and an aperture and a receptacle with a locking tab configured to receive and retain the apex area of one of the hanger rods. Leveling the light fixture by adjusting a location of the spring clip bracket along the length of one or both of the suspension rods.

In yet another exemplary embodiment, a method for providing a light fixture with a supporting and leveling system includes the following steps. Providing a light fixture having a plurality of connectors. Providing a pair of substantially V-shaped hanger rods, each hanger rod having an apex area and first and second ends, the first and second ends each configured to be coupled to one of the connectors. Providing a pair of suspension rods, each suspension rod configured to engage an overhead structure. Providing a pair of spring clip brackets, each spring clip bracket having a slot and an aperture configured to be releasably and adjustably secured along the length of one of the suspension rods, and also having a receptacle with a locking tab configured to receive and retain the apex area of one of the hanger rods.

Other principal features and advantages of the various embodiments of invention will become apparent to those skilled in the art upon review of the following drawings, the detailed description, and the appended claims.

BRIEF DESCRIPTION OF THE DRAWINGS

Exemplary embodiments will hereafter be described with reference to the accompanying drawings, wherein like numerals denote like elements.

DETAILED DESCRIPTION

Figure 1:
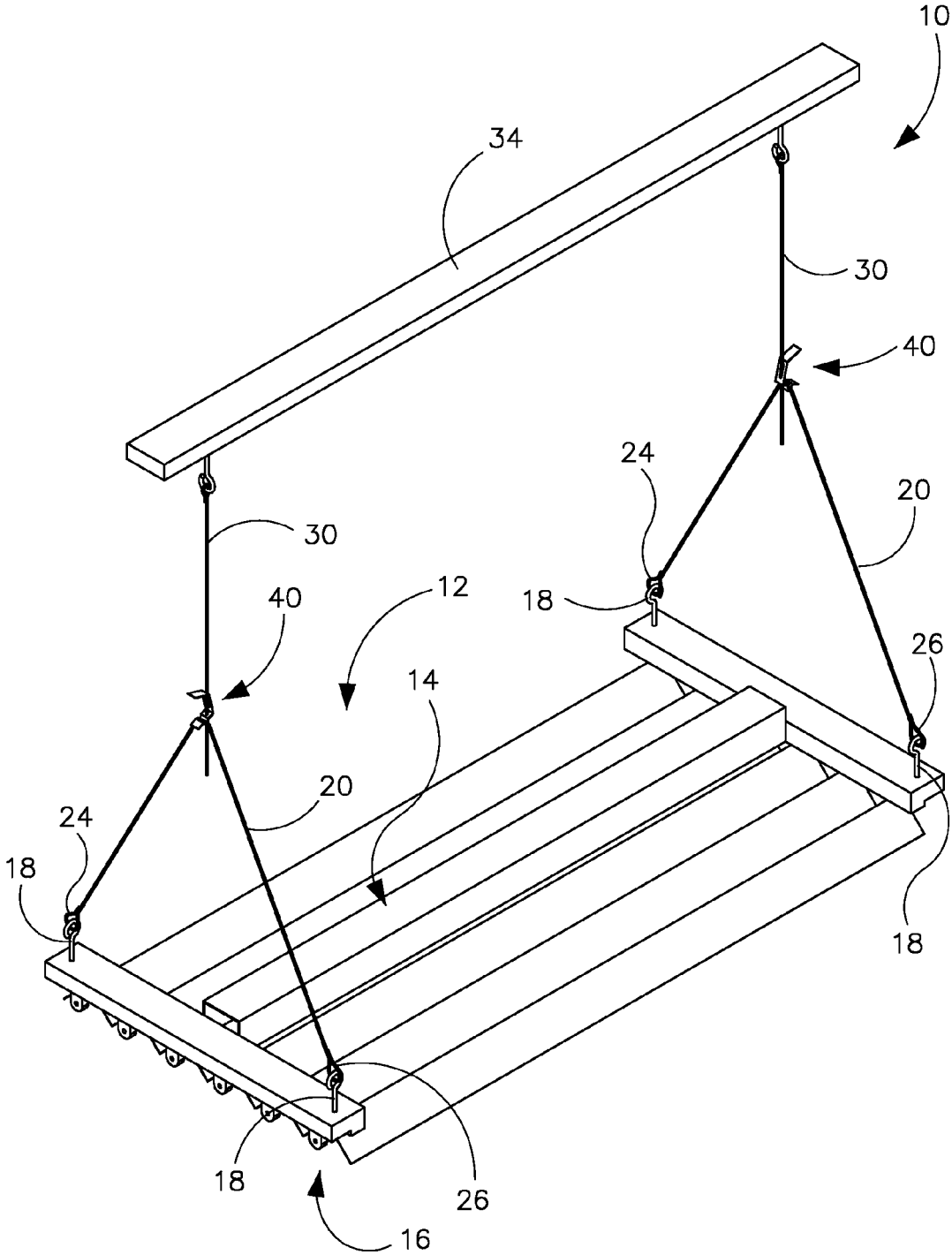
FIG. 1 depicts a schematic representation of a perspective view of a system for supporting and leveling a light fixture in accordance with an exemplary embodiment.
Figure 2:
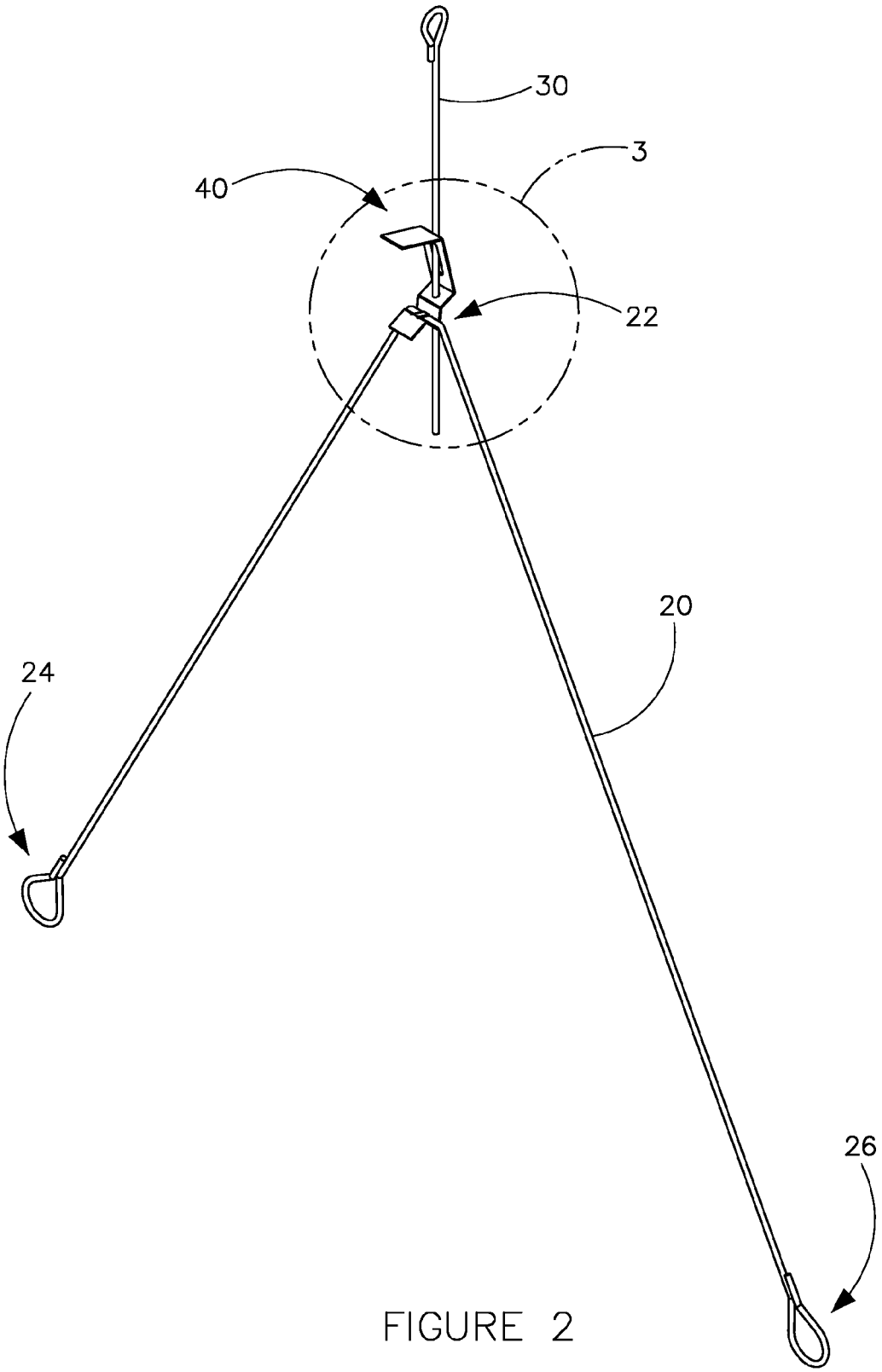
FIG. 2 depicts a schematic representation of a perspective view of an assembly including a hanger rod, a suspension rod and a spring clip bracket of the system of FIG. 1 in accordance with an exemplary embodiment.
Figure 3:
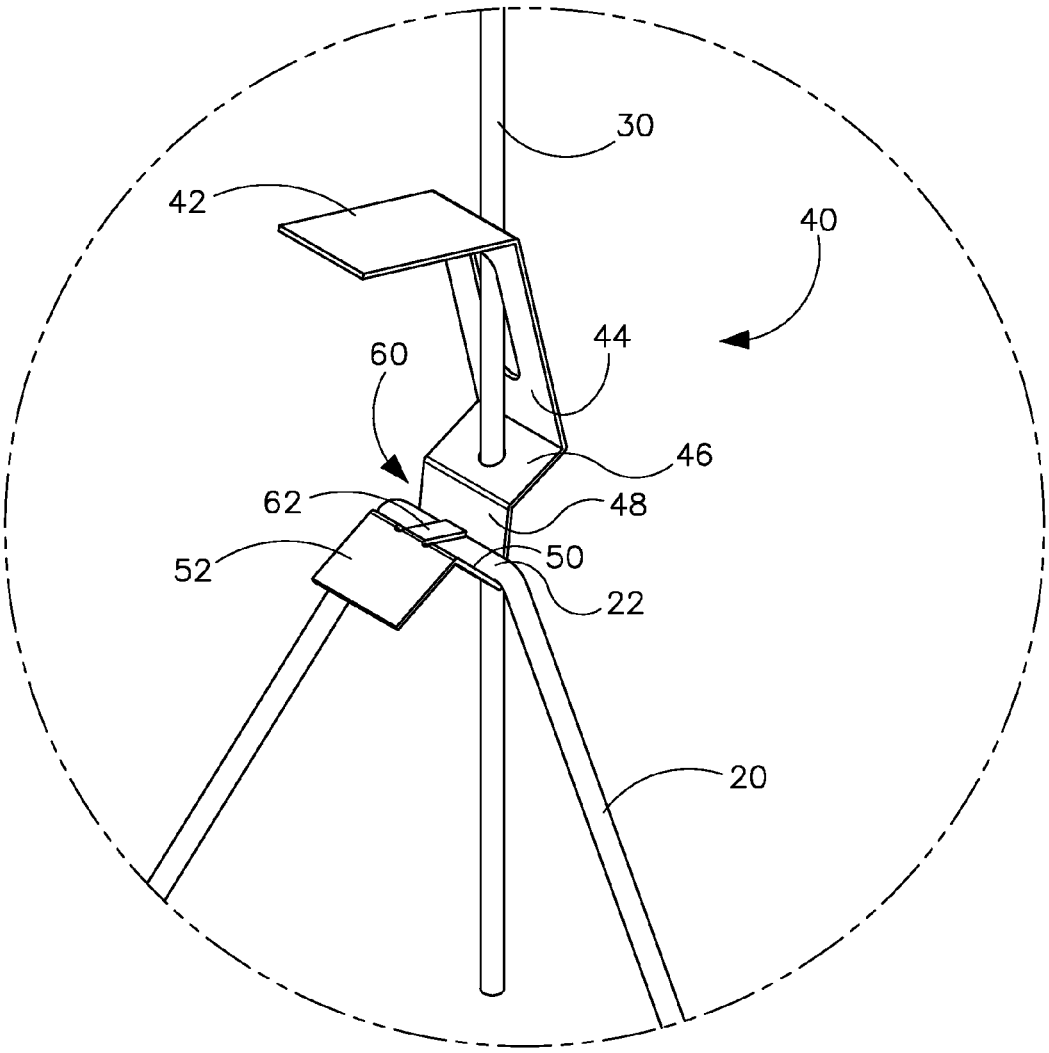
FIG. 3 depicts a depicts a schematic representation of a detailed perspective view of an assembly including a hanger rod, a suspension rod and a spring clip bracket of the system of FIG. 1 in accordance with an exemplary embodiment.

Referring generally to the FIGURES, a new and inventive system and method for supporting and leveling light fixtures is provided that overcomes the disadvantages of conventional lighting support systems, according to the illustrated embodiment. The inventive system and method of the present embodiments is shown to include two substantially V-shaped hanger rods having their respective free ends connected proximate opposite ends of the lighting fixture with respect to one another. A central apex area of each hanger rod is received and locked into a receptacle on a uniquely configured spring clip bracket, and the spring clip bracket is releasably and adjustably secured along a length of a suspension rod. The suspension rod may have any suitable length corresponding to the height of the overhead structure and the desired elevation of the light fixture, and has an upper end with a suitable connection structure (e.g. hook, loop, fastener, etc.) for attaching to any of a wide variety of overhead structures. The elevation and/or leveled position of the light fixture may be adjusted to a desired height or position by suitable adjustments of the position of spring clip brackets on the suspension members.

Referring to FIGS. 1-4B, a system 10 for supporting and leveling a light fixture 12 is shown according to an exemplary embodiment. System 10 is shown to include a light fixture 12 having a fixture body 14 supporting a plurality of light sources 16 (e.g. fluorescent lamps, LEDs, a hybrid combination of fluorescent lamps and LEDs, etc.). The fixture body 14 includes plurality of connectors 18 (e.g. hooks, loops, eyes, bars, etc.) on the fixture body 14 (shown on a top side of the fixture body 14). System 10 also includes a pair of hanger members 20 (e.g. rods, wires, etc.), where each hanger member 20 is substantially symmetric and formed in an approximate V-shape with a centrally-disposed apex area 22 and first and second ends 24, 26, the first and second ends 24, 26 are each formed with suitable connecting structure (shown by way of example as hooks) that are configured to be coupled to one of the connectors 18 on the fixture body 14. System 10 further includes a pair of suspension members 30 (e.g. rods, wires, etc.) shown by way of example as substantially straight or linear members with suitable connecting structure (shown by way of example as hooks) that are configured to engage an overhead structure 34 (e.g. ceiling or other overhead structure). System 10 also includes a pair of spring clip brackets 40 designed to adjustably and securely couple the hanger members 20 to the suspension members 30 for supporting and leveling the light fixtures 12. Each spring clip bracket 40 is configured to be releasably and adjustably secured at a location along the length of one of the suspension members 30, and is also configured to receive and retain the apex area 22 of one of the hanger members 20. According to one embodiment, the hanger members 20 and suspension members 30 are formed from substantially cylindrical metallic rods (e.g. steel, aluminum, etc.) having a diameter of approximately 0.125 inches, but may be provided from any suitable material and in any desirable shape and/or size for use in an intended application.

Figure 4B:
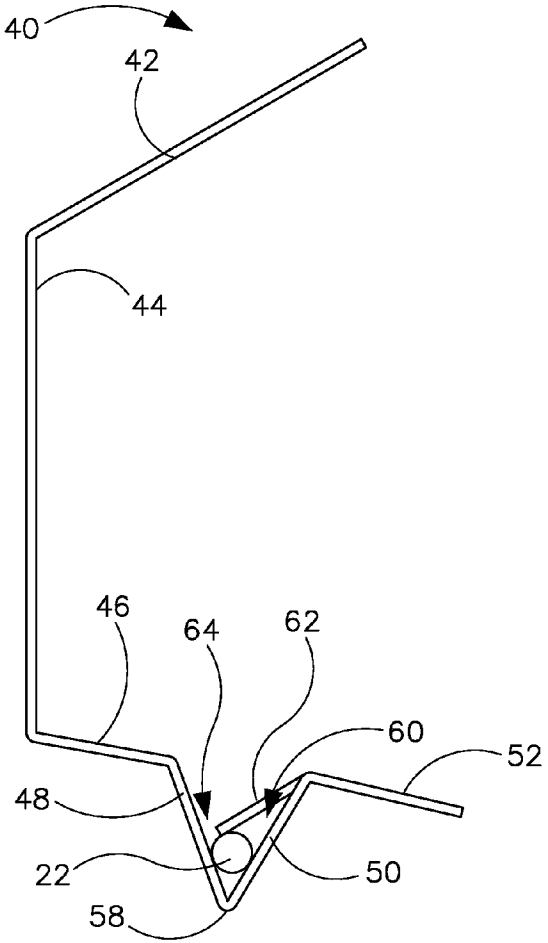
FIG. 4B depicts a schematic representation of a side view of a spring clip bracket of the system of FIG. 1 in accordance with an exemplary embodiment.
Figure 4A:
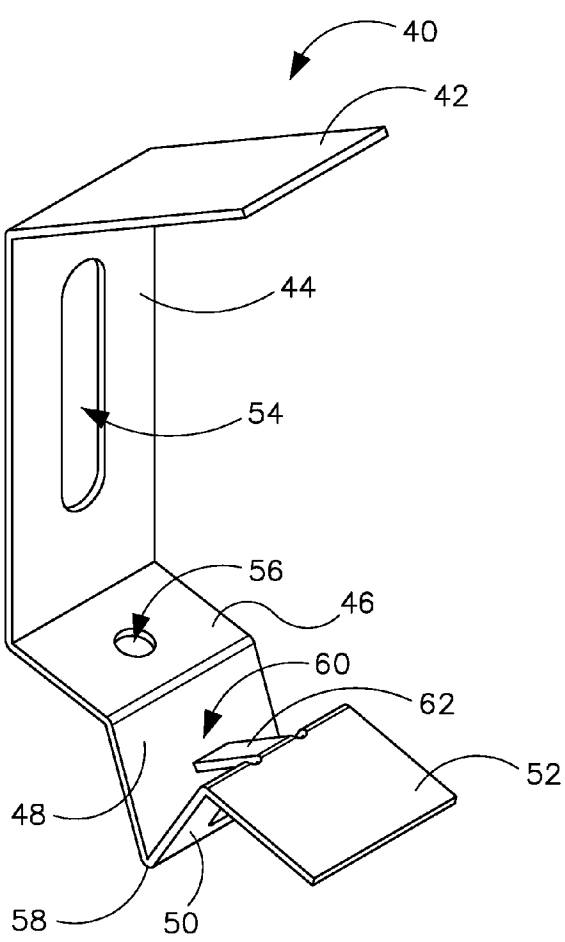
FIG. 4A depicts a schematic representation of a perspective view of a spring clip bracket of the system of FIG. 1 in accordance with an exemplary embodiment.

Referring further to FIGS. 4A-4B, the spring clip bracket 40 is shown in further detail according to an exemplary embodiment. Each spring clip bracket 40 is formed from a substantially flat piece (e.g. strip, etc.) of stainless steel spring stock having a thickness within a range of approximately 0.020-0.040 inches, and more preferably approximately 0.030 inches, and formed in a bending and/or stamping operation to have the following advantageous features for use in the system 10 for supporting and leveling the light fixture 12. Each spring clip bracket 40 is shown to include a first portion 42, a second portion 44, a third portion 46, a fourth portion 48, a fifth portion 50 and a sixth portion 52, that are contiguously arranged along the strip. The second portion 44 comprises an elongated slot 54 and the third portion 46 comprises a substantially cylindrical aperture 56, the slot 54 and the aperture 56 are configured to receive suspension member 30 therethrough so that their edges releasably and adjustably engage one of the suspension members 30. The first 42 and sixth portions 52 provide finger tabs that are movable between a compressed position where the edges of the slot 54 and the aperture 56 are not binding on the surface of the suspension member 30, so that the bracket 40 can movably engage the suspension member 30, and a released position where the edges of the slot 54 and the aperture 56 bind against the surface of the suspension member 30 from the resiliency of the strip material, so that the bracket 40 is fixed upon and secured to the suspension member 30 in a binding relationship between the edges of the aperture 56 and slot 54 and the surface of the suspension member 30. The fourth 48 and fifth portions 50 join at a bend 58 to form a substantially V-shaped receptacle 60 configured to receive the apex area 22 of the hanger member 20. One of the fourth 48 and fifth portions 50 (shown for example as the fifth portion 50) comprises a locking tab 62 having a free end disposed proximate the other of the fourth 48 and fifth portions 50 (shown for example as the fourth portion 48) and defining a gap 64 therebetween. The locking tab 62 is angled toward the receptacle 60 and has a length such that the gap 64 is smaller than a diameter of the apex area 22 of the hanger member 20, so that the apex area 22 of the hanger member 20 can be received in the receptacle 60 by pushing it through the gap 64 and into the receptacle 60 by flexing the locking tab 62 downward toward the receptacle 60, but the apex area 22 of the hanger member 20 cannot be removed from the receptacle 60 without bending the locking tab 62 upward and away from the receptacle 60.

According to one embodiment, the spring clip bracket 40 has the following characteristics: a width of approximately 0.625 inches; the first portion 42 has a length of approximately 1.20 inches; the second portion 44 has a length of approximately 1.576 inches; the slot 54 has a length of approximately 0.938 inches and a width of approximately 0.188 inches; the third portion 46 has a length of approximately 0.446 inches; the aperture 56 has a diameter within the range of approximately 0.128-0.133 inches; the fourth portion 48 has a length of approximately 0.520 inches; the fifth portion 50 has a length of approximately 0.511 inches; the sixth portion 52 has a length of approximately 0.48 inches; the locking tab 62 has a length of approximately 0.322 inches; the gap 64 is within a range of approximately 0.091-0.106 inches; the angle formed between the first 42 and second portions 44 is approximately 120 degrees; the angle formed between the second 44 and third portions 46 is approximately 100 degrees; the angle formed between the third 46 and fourth portions 48 is approximately 120 degrees; the angle formed between the fourth 48 and fifth portions 50 is approximately 51 degrees; the angle formed between the fifth 50 and sixth portions 52 is approximately 108 degrees; and the angle formed between the locking tab 62 and fifth portion 50 is approximately 28 degrees. However, according to alternative embodiments, other dimensions and angles may be used to suit any of a wide variety of light fixture applications.

Figure 5:
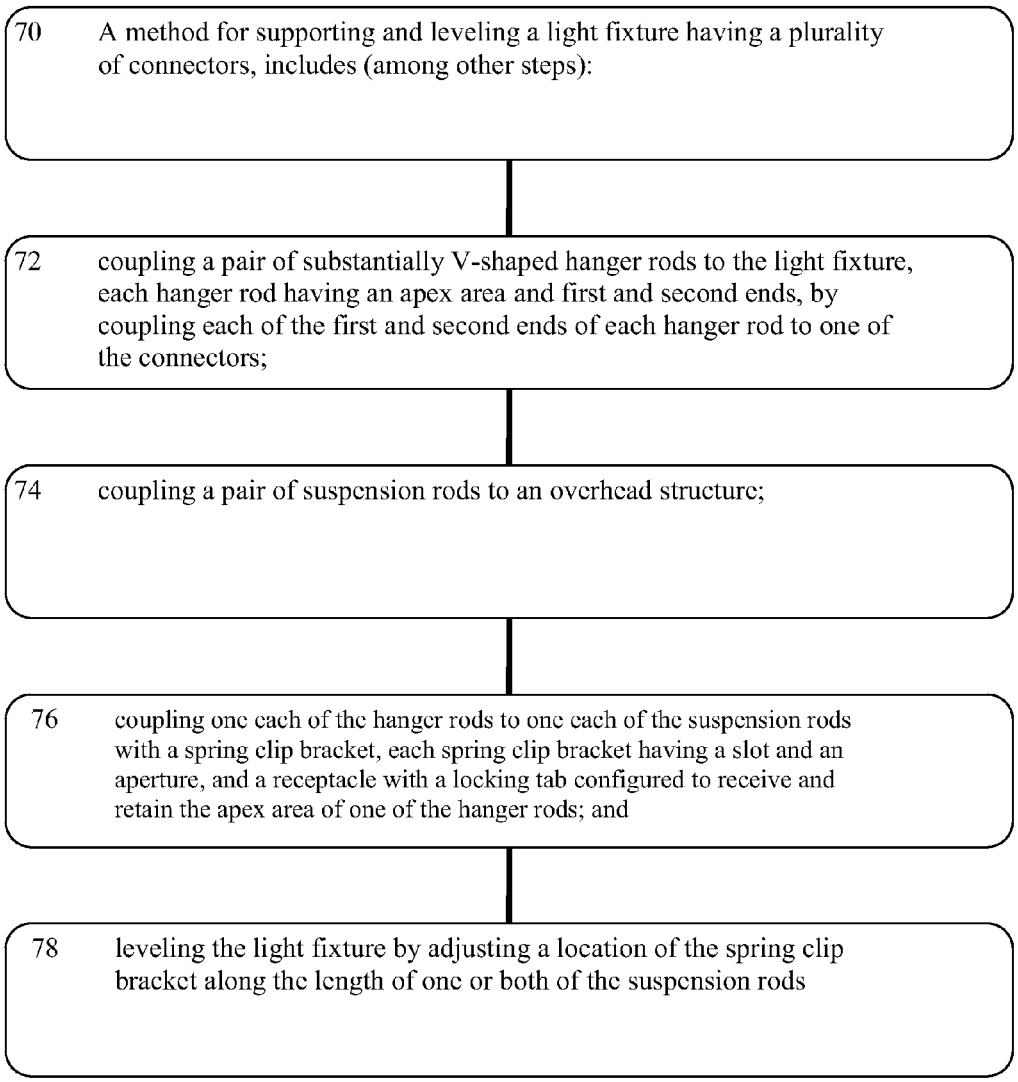
FIG. 5 depicts a flow diagram of steps for a method of supporting and leveling a light fixture having a plurality of connectors, in accordance with an exemplary embodiment.

Referring to FIG. 5, a method 70 for supporting and leveling a light fixture 12 having a plurality of connectors 18 is shown according to an exemplary embodiment and includes (among others) the following steps. 72 Coupling a pair of substantially V-shaped hanger rods 20 to the light fixture 12, each hanger rod 20 having an apex area 22 and first and second ends 24, 26, by coupling each of the first and second ends 24, 26 of each hanger rod 20 to one of the connectors 18. 74 Coupling a pair of suspension rods 30 to an overhead structure 34. 76 Coupling one each of the hanger rods 20 to one each of the suspension rods 30 with a spring clip bracket 40, each spring clip bracket 40 having a slot 54 and an aperture 56 and a receptacle 60 with a locking tab 62 configured to receive and retain the apex area 22 of one of the hanger rods 20. 78 Leveling the light fixture 12 by adjusting a location of the spring clip bracket 40 along the length of one or both of the suspension rods 30.

Figure 6:
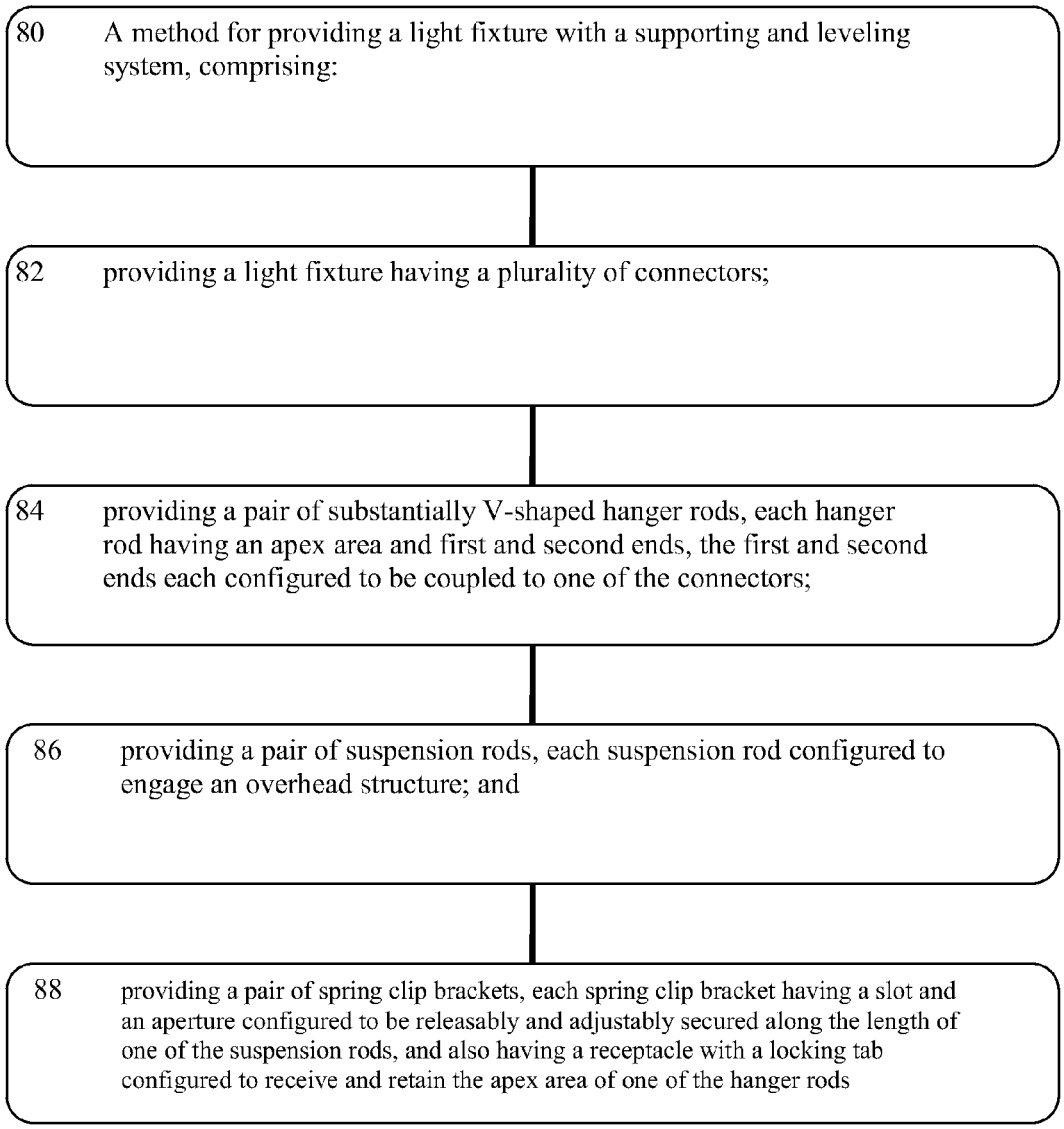
FIG. 6 depicts a flow diagram of steps for a method providing a light fixture with a supporting and leveling system, in accordance with an exemplary embodiment.

Referring to FIG. 6, a method 80 for providing a light fixture 12 with a supporting and leveling system 10 is shown according to an exemplary embodiment and includes the following steps. 82 Providing a light fixture 12 having a plurality of connectors 18. 84 Providing a pair of substantially V-shaped hanger rods 20, each hanger rod 20 having an apex area 22 and first and second ends 24, 26, the first and second ends 24, 26 each configured to be coupled to one of the connectors 18. 86 Providing a pair of suspension rods 30, each suspension rod 30 configured to engage an overhead structure 34. 88 Providing a pair of spring clip brackets 40, each spring clip bracket 40 having a slot 54 and an aperture 56 configured to be releasably and adjustably secured along the length of one of the suspension rods 30, and also having a receptacle 60 with a locking tab 62 configured to receive and retain the apex area 22 of one of the hanger rods 20.

According to any exemplary embodiment, a system and method for supporting and leveling a light fixture is provided for use with any of a wide variety of overhead structures. Two substantially V-shaped hanger rods have their respective free ends connected proximate opposite ends of the light fixture with respect to one another. An apex area of each hanger rod is received and locked into a receptacle on a spring clip bracket, and the spring clip bracket is releasably and adjustably secured along a length of a suspension rod. The suspension rod has an upper end with a suitable connection structure (e.g. hook, loop, fastener, etc.) for attaching to any of a wide variety of overhead structures. The elevation and/or leveled position of the light fixture may be adjusted to a desired height or position by suitable adjustments of the position of the one or both spring clip brackets on the suspension member(s).

The word "exemplary" is used herein to mean serving as an example, instance, or illustration. Any aspect or design described herein as "exemplary" is not necessarily to be construed as preferred or advantageous over other aspects or designs. Further, for the purposes of this disclosure and unless otherwise specified, "a" or "an" means "one or more".

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It should be noted that the orientation of various elements may differ according to other exemplary embodiments, and that such variations are intended to be encompassed by the present disclosure.

The disclosure is described above with reference to drawings. These drawings illustrate certain details of specific embodiments that implement the systems and methods and programs of the present disclosure. However, describing the disclosure with drawings should not be construed as imposing on the disclosure any limitations that may be present in the drawings. The present disclosure contemplates methods, systems and program products on any machine-readable media for accomplishing its operations. The embodiments of the present disclosure may be implemented using an existing computer processor, or by a special purpose computer processor incorporated for this or another purpose or by a hardwired system. No claim element herein is to be construed under the provisions of 35 U.S.C. §112, sixth paragraph, unless the element is expressly recited using the phrase "means for." Furthermore, no element, component or method step in the present disclosure is intended to be dedicated to the public, regardless of whether the element, component or method step is explicitly recited in the claims.

The foregoing description of exemplary embodiments of the invention have been presented for purposes of illustration and of description. It is not intended to be exhaustive or to limit the invention to the precise form disclosed, and modifications and variations are possible in light of the above teachings or may be acquired from practice of the invention. The functionality described may be distributed among modules that differ in number and distribution of functionality from those described herein. Additionally, the order of execution of the functions may be changed depending on the embodiment. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. A light fixture, comprising:

a fixture body supporting one or more light sources;

a plurality of connectors on the fixture body;

a pair of hanger members, each hanger member having an apex area and first and second ends, the first and second ends each configured to be coupled to one of the connectors;

a pair of suspension members, each suspension member configured to engage an overhead structure; and a pair of brackets, each bracket configured to be releasably and adjustably secured at a location along the length of one of the suspension members, and configured to receive and retain the apex area of one of the hanger members;

wherein the hanger members and suspension members comprises substantially cylindrical metallic rods, wherein each bracket comprises a spring clip, and wherein the spring clip comprises a first portion, a second portion, a third portion, a fourth portion, a fifth portion and a sixth portion.

2. The light fixture of claim 1 wherein the second portion comprises an elongated slot and the third portion comprises a substantially cylindrical aperture, the slot and the aperture configured to receive and releasably and adjustably engage one of the suspension members.

3. The light fixture of claim 2 wherein the first and sixth portions provide finger tabs that are movable between a compressed position where the slot and the aperture are configured to movably engage the suspension member, and a released position where the slot and the aperture are configured to non-movably engage upon and secure to the suspension member.

4. The light fixture of claim 3 wherein the fourth and fifth portions form a receptacle configured to receive the apex area of the hanger member.

5. The light fixture of claim 4 wherein one of the fourth and fifth portions comprises a locking tab having a free end disposed proximate the other of the fourth and fifth portions and defining a gap therebetween.

6. The light fixture of claim 5 wherein the locking tab is angled toward the receptacle and the gap is smaller than a diameter of the apex area of the hanger member, so that the apex area of the hanger member can be received in the receptacle by flexing the locking tab toward the receptacle, but the apex area of the hanger member cannot be removed from the receptacle without bending the locking tab away from the receptacle.

7. A light fixture, comprising:

a fixture body supporting one or more light sources;

a plurality of connectors on the fixture body;

a pair of V-shaped hanger rods, each hanger rod having an apex area and first and second ends, the first and second ends each configured to be coupled to one of the connectors;

a pair of suspension rods, each suspension rod configured to engage an overhead structure; and a pair of spring clip brackets, each spring clip bracket having a slot and an aperture configured to be releasably and adjustably secured along the length of one of the suspension rods, and also having a receptacle with a locking tab configured to receive and retain the apex area of one of the hanger rods.

8. The light fixture of claim 7 wherein the locking tab is angled toward the receptacle and defines a gap that is smaller than the apex area of the hanger rod, so that the apex area of the hanger rod can be received in the receptacle by flexing the locking tab toward the receptacle, but the apex area of the hanger rod cannot be removed from the receptacle without bending the locking tab away from the receptacle.

9. The light fixture of claim 7 wherein the light sources comprise at least one of a fluorescent lamp, LEDs and a hybrid combination of both fluorescent lamps and LEDs.

10. A method for supporting and leveling a light fixture having a plurality of connectors, comprising:

coupling a pair of substantially V-shaped hanger rods to the light fixture, each hanger rod having an apex area and first and second ends, by coupling each of the first and second ends of each hanger rod to one of the connectors;

coupling a pair of suspension rods to an overhead structure; and coupling one each of the hanger rods to one each of the suspension rods with a spring clip bracket, each spring clip bracket having a slot and an aperture, and a receptacle with a locking tab configured to receive and retain the apex area of one of the hanger rods; and positioning the light fixture by adjusting a location of the spring clip bracket along the length of one or both of the suspension rods.

11. A method for providing a light fixture with a supporting and leveling system, comprising:

providing a light fixture having a plurality of connectors;

providing a pair of substantially V-shaped hanger rods, each hanger rod having an apex area and first and second ends, the first and second ends each configured to be coupled to one of the connectors;

providing a pair of suspension rods, each suspension rod configured to engage an overhead structure; and providing a pair of spring clip brackets, each spring clip bracket having a slot and an aperture configured to be releasably and adjustably secured along the length of one of the suspension rods, and also having a receptacle with a locking tab configured to receive and retain the apex area of one of the hanger rods.

* * * * *